US011499553B2

(12) United States Patent
Bou Dargham et al.

(10) Patent No.: US 11,499,553 B2
(45) Date of Patent: Nov. 15, 2022

(54) SCROLL COMPRESSOR INCLUDING A CRANKPIN HAVING AN UPPER RECESS

(71) Applicant: Danfoss Commercial Compressors, Trevoux (FR)

(72) Inventors: Remi Bou Dargham, Villeurbanne (FR); Arnaud Daussin, Trevoux (FR); Dominique Gross, Jassans Riottier (FR)

(73) Assignee: Danfoss Commercial Compressors, Trevoux (FR)

( * ) Notice: Subject to any disclaimer, the term of this patent is extended or adjusted under 35 U.S.C. 154(b) by 0 days.

(21) Appl. No.: 17/087,954

(22) Filed: Nov. 3, 2020

(65) Prior Publication Data

US 2021/0131431 A1 May 6, 2021

(30) Foreign Application Priority Data

Nov. 5, 2019 (FR) ..... 19/12393

(51) Int. Cl.
*F04C 18/02* (2006.01)
*F04C 29/00* (2006.01)

(52) U.S. Cl.
CPC ..... *F04C 18/0215* (2013.01); *F04C 29/0057* (2013.01); *F04C 2240/50* (2013.01); *F04C 2240/60* (2013.01); *F04C 2240/601* (2013.01)

(58) Field of Classification Search
CPC ..... F04C 29/0071; F04C 29/0078; F04C 29/0057; F04C 2240/60; F04C 2240/601; F04C 18/0215–0292
See application file for complete search history.

(56) References Cited

U.S. PATENT DOCUMENTS 5,076,772 A 12/1991 Fraser, Jr. et al.
6,709,247 B1 3/2004 Clendenin et al.
(Continued)

FOREIGN PATENT DOCUMENTS

CN 1751183 A 3/2006
CN 1769708 A 5/2006
(Continued)

OTHER PUBLICATIONS

India First Examination Report corresponding to Indian Application No. 202014046620.

*Primary Examiner* — Mark A Laurenzi
*Assistant Examiner* — Xiaoting Hu
(74) *Attorney, Agent, or Firm* — McCormick, Paulding & Huber PLLC

(57) ABSTRACT

The scroll compressor comprises a fixed scroll having a fixed end plate and a fixed spiral wrap extending from the fixed end plate; an orbiting scroll (9) having an orbiting end plate and an orbiting spiral wrap extending from the orbiting end plate, the fixed spiral wrap and the orbiting spiral wrap meshing with each other to form compression chambers; a vertical drive shaft (19) having a crankpin (21) at an upper end portion of the vertical drive shaft (19), the crankpin (21) including an outer circumferential surface (23) cooperating with an orbiting scroll bearing (24). The crankpin (21) includes a recess (25) formed in an axial end face (26) of the crankpin (21), the recess (25) and an upper portion (27) of the outer circumferential surface (23) defining therebetween a circumferential wall (28) extending along at least a part of the circumference of the crankpin (21), the circumferential wall (28) being deformable in a radial direction during operation of the scroll compressor.

19 Claims, 5 Drawing Sheets

(56) References Cited

U.S. PATENT DOCUMENTS

| | | | | |
|---|---|---|---|---|
| 7,247,009 | B2 | 7/2007 | Sun | |
| 9,709,058 | B2 * | 7/2017 | Kanayama | F04C 18/356 |
| 2005/0207926 | A1 * | 9/2005 | Nishiwaki | F04C 18/0215 418/55.2 |
| 2006/0093506 | A1 * | 5/2006 | Kim | F04C 29/0021 418/55.1 |
| 2007/0003424 | A1 * | 1/2007 | Benco | F04C 29/0057 418/55.3 |
| 2007/0077160 | A1 | 4/2007 | Sun | |
| 2011/0067434 | A1 * | 3/2011 | Miura | F04C 23/001 62/498 |
| 2014/0219833 | A1 * | 8/2014 | Kanayama | F04C 23/008 417/321 |
| 2014/0234147 | A1 * | 8/2014 | Tomioka | F04C 18/322 418/54 |
| 2016/0018136 | A1 * | 1/2016 | Hirayama | F04C 29/0085 62/401 |
| 2017/0314557 | A1 | 11/2017 | Matsui et al. | |
| 2018/0051697 | A1 * | 2/2018 | Murakami | F04C 15/0088 |
| 2018/0238596 | A1 * | 8/2018 | Gotou | F04C 18/3564 |
| 2018/0363653 | A1 * | 12/2018 | Koyama | F04C 29/0028 |
| 2019/0178248 | A1 * | 6/2019 | Yosuke | F04C 18/02 |
| 2019/0368493 | A1 * | 12/2019 | Kumakura | F04C 29/023 |

FOREIGN PATENT DOCUMENTS

| | | | |
|---|---|---|---|
| CN | 103502645 | B2 | 7/2016 |
| CN | 106151029 | A | 11/2016 |
| CN | 106401968 | A * | 2/2017 |
| EP | 2700818 | A1 | 2/2014 |
| JP | 2005201148 | A | 7/2005 |
| KR | 10-0575697 | B1 | 5/2006 |
| WO | 2005068841 | A1 | 7/2005 |

* cited by examiner

[Fig. 1]
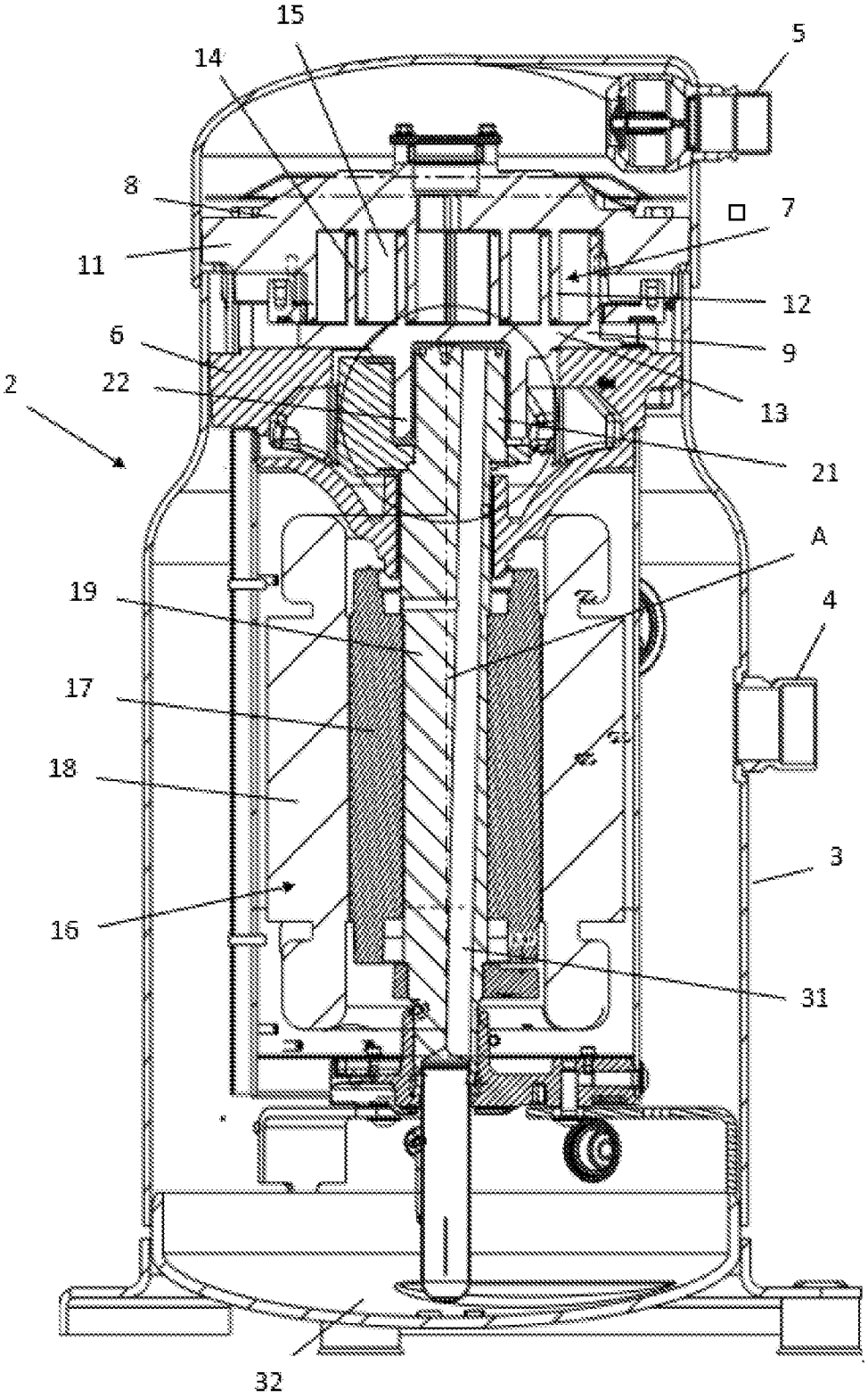

[Fig. 2]
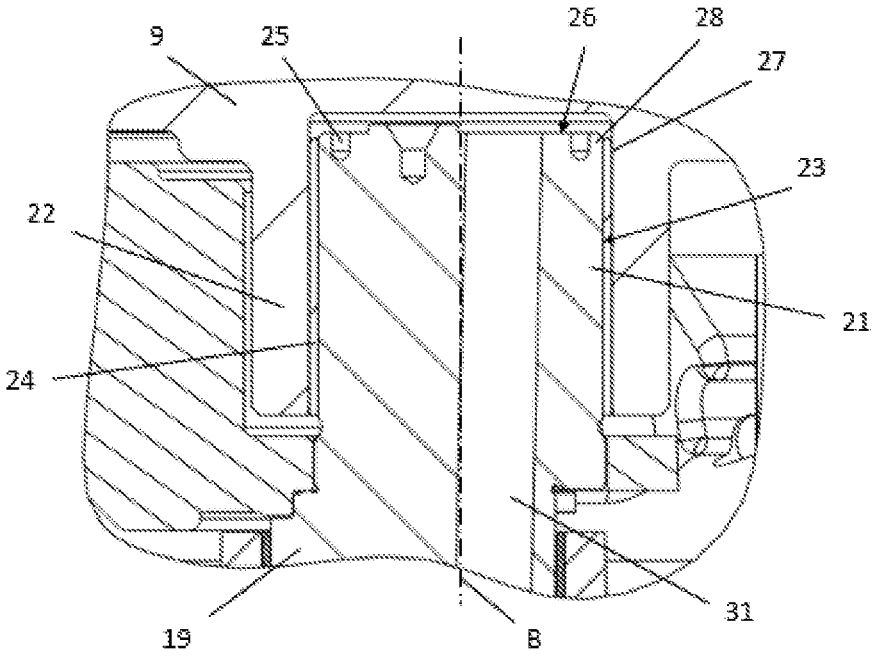
[Fig. 3]
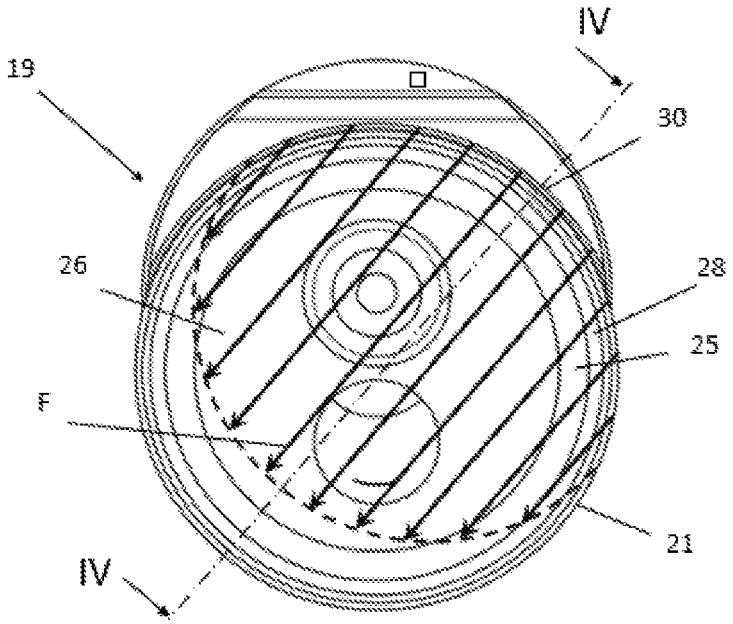

[Fig. 4]
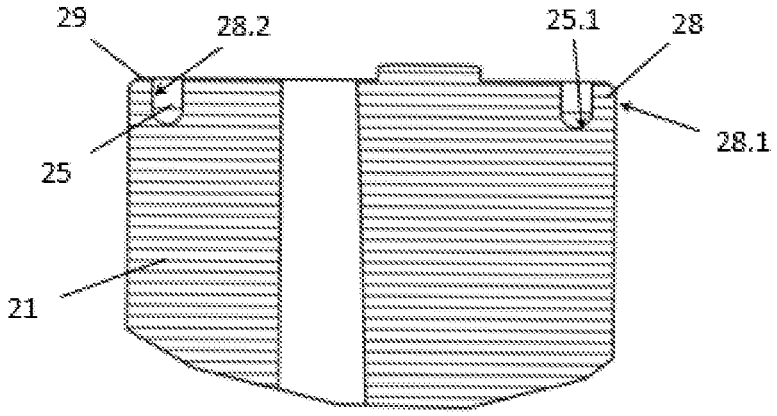
[Fig. 5]
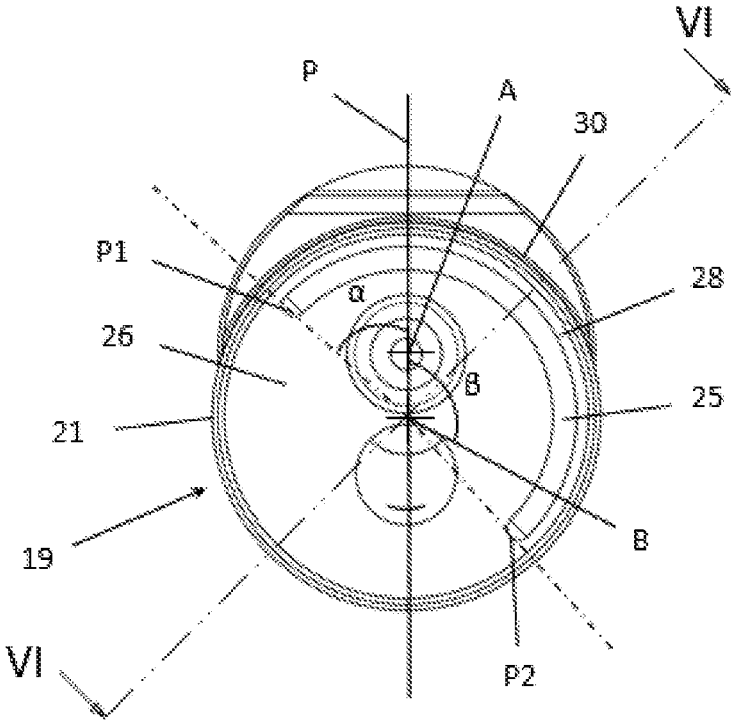

[Fig. 6]
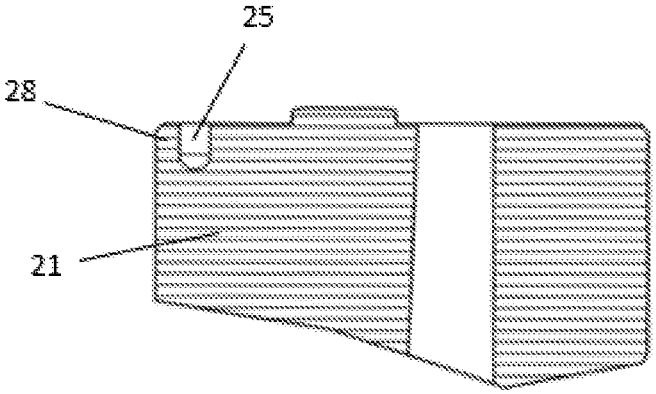
[Fig. 7]
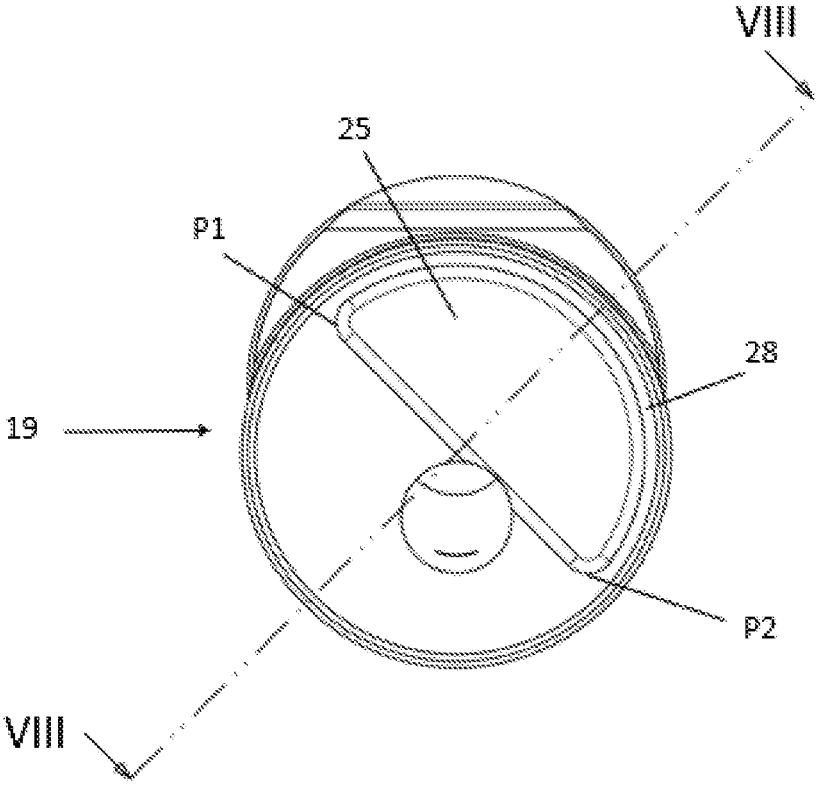

[Fig. 8]
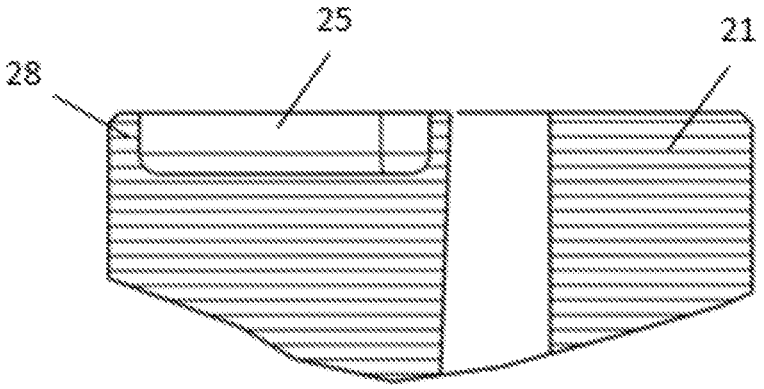

SCROLL COMPRESSOR INCLUDING A CRANKPIN HAVING AN UPPER RECESS

CROSS-REFERENCE TO RELATED APPLICATION

This application claims foreign priority benefits under 35 U.S.C. § 119 to French Patent Application No. 19/12393 filed on Nov. 5, 2019, the content of which is hereby incorporated by reference in its entirety.

TECHNICAL FIELD

The present invention relates to a scroll compressor, and in particular to a scroll refrigeration compressor.

BACKGROUND

As known, a scroll compressor comprises:

- a fixed scroll having a fixed end plate and a fixed spiral wrap extending from the fixed end plate,
- an orbiting scroll having an orbiting end plate and an orbiting spiral wrap extending from the orbiting end plate, the fixed spiral wrap and the orbiting spiral wrap meshing with each other to form compression chambers,
- a vertical drive shaft having a crankpin at an upper end portion of the vertical drive shaft, the crankpin including an outer circumferential surface cooperating with an orbiting scroll bearing provided on the orbiting scroll.

Generally, the orbiting scroll has a tendency to perform a tilting or wobble movement during the scroll compressor operation. This is due to a tilting moment resulting from different forces acting on the orbiting scroll at different axial and/or radial positions, such as gas forces in the compression chambers, frictional forces generated in the vertical drive shaft bearings or inertia forces.

This wobbling movement may result in unwanted loads on the drive shaft bearings, which are mounted in static compressor parts (notably in a lower bearing support and an upper main bearing support), due to deformation of the vertical drive shaft itself.

Further, a considerable edge loading effect is observed between the orbiting scroll bearing mounted in a connecting sleeve part, also namned hub part, of the orbiting scroll and the crankpin of the vertical drive shaft, which may harm the integrity of the orbiting scroll bearing.

U.S. Pat. No. 5,076,772 discloses a scroll compressor including an orbiting scroll having a boss received in a bore of a slider block which is received in an elongated recess provided in the axial end face of a vertical drive shaft. Particularly, the slider block includes deformable pads circumferentially arranged in the contact surface between the boss of the orbiting scroll and the slider block. The deformable pads collectively define a deflection bearing which permits relative canting between the orbiting scroll and the vertical drive shaft without producing edge loading when the vertical drive shaft rotates about its rotational axis.

However, the manufacturing cost of such a slider block is relatively important, which substantially increase the manufacturing cost of the scroll compressor.

SUMMARY

It is an object of the present invention to provide an improved scroll compressor which can overcome the drawbacks encountered in conventional scroll compressors.

Another object of the present invention is to provide a scroll compressor which has a simple and economical structure, while having an increased lifetime of the orbiting scroll bearing.

According to the invention such a scroll compressor comprises:

- a fixed scroll having a fixed end plate and a fixed spiral wrap extending from the fixed end plate,
- an orbiting scroll having an orbiting end plate and an orbiting spiral wrap extending from the orbiting end plate, the fixed spiral wrap and the orbiting spiral wrap meshing with each other to form compression chambers,
- a vertical drive shaft having a crankpin at an upper end portion of the vertical drive shaft, the crankpin including an outer circumferential surface cooperating with an orbiting scroll bearing,
- wherein the crankpin includes a recess formed in an axial end face of the crankpin, the recess and an upper portion of the outer circumferential surface defining therebetween a circumferential wall extending along at least a part of the circumference of the crankpin, the circumferential wall being deformable in a radial direction, with respect to the crankpin axis of the crankpin, during operation of the scroll compressor, and particularly when the orbiting scroll performs tilting or wobbling movements and applies a contact pressure on the circumferential wall.

Such a circumferential wall, which defines a crankpin portion with reduced stiffness and which is deformable in a radial direction when the orbiting scroll performs tilting or wobbling movements, strongly reduces the contact pressure between the orbiting scroll bearing and the outer circumferential surface of the crankpin, and thus increases the lifetime of the orbiting scroll bearing without using complex drive shaft bearings.

The scroll compressor may also include one or more of the following features, taken alone or in combination.

According to an embodiment of the invention, the circumferential wall has a curved shaped, and for example a substantially arcuate shape or an annular shape.

According to an embodiment of the invention, the circumferential wall has a substantially constant thickness along a circumference thereof.

According to an embodiment of the invention, the circumferential wall includes an inner circumferential wall surface and an outer circumferential wall surface, the outer circumferential wall surface being defined by the outer circumferential surface of the crankpin.

According to an embodiment of the invention, the inner circumferential wall surface and the outer circumferential wall surface are substantially parallel relative to each other.

Advantageously, the inner and outer circumferential wall surfaces are centered on the crankpin axis of the crankpin.

According to an embodiment of the invention, the inner circumferential wall surface is cylindrical.

According to an embodiment of the invention, the outer circumferential surface of the crankpin is cylindrical.

According to an embodiment of the invention, the inner circumferential wall surface diverges from a bottom surface of the recess towards the axial end face of the crankpin.

According to an embodiment of the invention, the recess is radially shifted from the outer circumferential surface of the crankpin. Such a configuration of the recess ensures that the outer circumferential surface of the crankpin cooperating with the orbiting scroll bearing is preserved.

According to an embodiment of the invention, the circumferential wall extends at least in a region where bearing loads applied on the outer circumferential surface of the crankpin are maximal.

According to an embodiment of the invention, the circumferential wall extends between a first predetermined circumferential position and a second predetermined circumferential position over an angle of at least 120°, and for example of around 180°, centred on the crankpin axis of the crankpin.

According to an embodiment of the invention, the first predetermined circumferential position is located in a first half-space defined by a reference plane including the crankpin axis and a rotational axis of the vertical drive shaft, and the second predetermined circumferential position is located in a second half-space defined by the reference plane.

According to an embodiment of the invention, a first orthogonal projection of the first predetermined circumferential position in a projection plane, which is orthogonal to the crankpin axis and to the rotational axis of the vertical drive shaft, and a reference half-line, which includes an initial point corresponding to an orthogonal projection of the crankpin axis in the projection plane and which passes through a reference point corresponding to an orthogonal projection of the rotational axis of the vertical drive shaft in the projection plane, define a first angle which is centred on the initial point and which is between 0° and 180°, and for example between 0° and 60°, the first angle being measured in a first measurement direction from the reference half-line.

According to an embodiment of the invention, the first angle is between 30° and 60°, and for example around 45°.

According to an embodiment of the invention, the reference half-line and a second orthogonal projection of the second predetermined circumferential position in the projection plane define a second angle which is centred on the initial point and which is between 90° and 180°, and for example between 90° and 150°, the second angle being measured in a second measurement direction from the reference half-line which is opposite to the first measurement direction.

According to an embodiment of the invention, the second angle is between 110° and 150°, and for example around 120° or around 135°.

According to another embodiment of the invention, the first angle is around 0°, and the second angle is around 120°.

According to another embodiment of the invention, the first angle is around 45°, and the second angle is around 135°.

According to an embodiment of the invention, the first and second predetermined circumferential positions are angularly offset relative to each other.

According to an embodiment of the invention, the first and second predetermined circumferential positions are substantially identical such that the circumferential wall extends over an angle of around 360°.

According to an embodiment of the invention, the circumferential wall has a thickness and a height which are configured to ensure pure elastic deformation of the circumferential wall during operation of the scroll compressor.

According to an embodiment of the invention, the recess has a depth which is configured such that the circumferential wall axially overlaps at least a portion of the orbiting scroll bearing.

According to an embodiment of the invention, the recess is formed by a groove, and for example by an annular groove or a semi-circular groove.

According to an embodiment of the invention, the recess has a substantially half-disc shape.

According to an embodiment of the invention, the circumferential wall has upper edge having a tapered or rounded shape.

According to an embodiment of the invention, the vertical drive shaft includes an oil supplying channel configured to fluidly communicate with an oil sump of the scroll compressor, the oil supplying channel extending over at least a part of the length of the vertical drive shaft and having an upper end emerging into the axial end face of the crankpin.

According to an embodiment of the invention, the orbiting scroll bearing is disposed within a connecting sleeve part of the orbiting scroll, the crankpin 21 being inserted in the connecting sleeve part of the orbiting scroll. Advantageously, the connecting sleeve part extends from the orbiting end plate.

The present invention also relates to a vertical drive shaft for a scroll compressor, having a crankpin at an upper end portion of the vertical drive shaft, the crankpin including an outer circumferential surface configured to cooperate with an orbiting scroll bearing, wherein the crankpin includes a recess formed in an axial end face of the crankpin, the recess and an upper portion of the outer circumferential surface defining therebetween a circumferential wall extending along at least a part of the circumference of the crankpin.

These and other advantages will become apparent upon reading the following description in view of the drawing attached hereto representing, as non-limiting examples, embodiments of a scroll compressor according to the invention.

BRIEF DESCRIPTION OF THE DRAWINGS

The following detailed description of several embodiments of the invention is better understood when read in conjunction with the appended drawings being understood, however, that the invention is not limited to the specific embodiments disclosed.

FIG. 1 is a longitudinal section view of a scroll compressor according to a first embodiment of the invention.

FIG. 2 is an enlarged view of a detail of FIG. 1.

FIG. 3 is a top view of a vertical drive shaft of the scroll compressor of FIG. 1.

FIG. 4 is a cross section view taken along line IV-IV of FIG. 3.

FIG. 5 is top view of a vertical drive shaft of a scroll compressor according to a second embodiment of the invention.

FIG. 6 is a cross section view taken along line VI-VI of FIG. 5.

FIG. 7 is top view of a vertical drive shaft of a scroll compressor according to a third embodiment of the invention.

FIG. 8 is a cross section view taken along line VIII-VIII of FIG. 7.

DETAILED DESCRIPTION

FIG. 1 shows a scroll compressor 2 comprising a hermetic casing 3 provided with a suction inlet 4 configured to supply the scroll compressor 2 with refrigerant to be compressed, and with a discharge outlet 5 configured to discharge compressed refrigerant.

The scroll compressor 2 also comprises a support frame 6 arranged within the hermetic casing 3 and secured to the hermetic casing 3, and a compression unit 7 also arranged within the hermetic casing 3 and disposed above the support frame 6. The compression unit 7 is configured to compress the refrigerant supplied by the suction inlet 4, and includes a fixed scroll 8 and an orbiting scroll 9 interfitting with each other. In particular, the orbiting scroll 9 is supported by and in slidable contact with an upper face of the support frame 6, and the fixed scroll 8 is fixed in relation to the hermetic casing 3.

The fixed scroll 8 has a fixed end plate 11, a fixed spiral wrap 12 projecting from the fixed end plate 11 towards the orbiting scroll 9. The orbiting scroll 9 has an orbiting end plate 13 and an orbiting spiral wrap 14 projecting from from a first face of the orbiting end plate 13 towards the fixed scroll 8. The orbiting spiral wrap 14 of the orbiting scroll 9 meshes with the fixed spiral wrap 12 of the fixed scroll 8 to form a plurality of compression chambers 15 between them. The compression chambers 15 have a variable volume which decreases from the outside towards the inside, when the orbiting scroll 9 is driven to orbit relative to the fixed scroll 8.

The scroll compressor 2 further comprises an electric motor 16 disposed below the support frame 6. The electric motor 16 has a rotor 17, and a stator 18 disposed around the rotor 17.

Furthermore, the scroll compressor 2 comprises a vertical drive shaft 19 connected to the rotor 17 of the electrical motor 16 and configured to drive the orbiting scroll 9 in an orbital movement.

The vertical drive shaft 19 comprises, at an upper end portion of the vertical drive shaft 19, a crankpin 21 which is off-centered from a rotational axis A of the vertical drive shaft 19, and which is inserted in a connecting sleeve part 22 of the orbiting scroll 9 so as to cause the orbiting scroll 9 to be driven in an orbital movement relative to a fixed scroll 8 when the electric motor 16 is operated. The connecting sleeve part 22 particularly projects from a second face of the orbiting end plate 13.

The crankpin 21 includes an outer circumferential surface 23 cooperating with an orbiting scroll bearing 24 mounted within the connecting sleeve part 22 of the orbiting scroll 9.

The crankpin 21 further includes a recess 25 which is formed in an axial end face 26 of the crankpin 21 and which is radially shifted from the outer circumferential surface 23 of the crankpin 21. In other terms, the recess 25 does not emerge into the outer circumferential surface 23. Such a configuration of the recess 25 ensures that the outer circumferential surface 23 of the crankpin 21 cooperating with the orbiting scroll bearing 24 is preserved. According to the first embodiment of the invention shown in FIGS. 1 to 4, the recess 25 is formed by an annular circumferential groove.

Advantageously, the recess 25 and an upper portion 27 of the outer circumferential surface 23 define therebetween a circumferential wall 28 having a curved shape and extending along at least a part of the circumference of the crankpin 21. According to the first embodiment of the invention shown in FIGS. 1 to 4, the circumferential wall 28 has an annular shape and extends along the entire circumference of the crankpin 21. Advantageously, the circumferential wall 28 has a constant thickness along its circumference.

The circumferential wall 28 includes an outer circumferential wall surface 28.1 which is defined by the outer circumferential surface 23 of the crankpin 21, and an inner circumferential wall surface 28.2 which is parallel to the outer circumferential wall surface 28.1. According to the first embodiment of the invention shown in FIGS. 1 to 4, the outer and inner circumferential wall surfaces 28.1, 28.2 are centered on the crankpin axis B and are cylindrical. However, according to an other embodiment of the invention, the inner circumferential wall surface may diverge from a bottom surface 25.1 of the recess 25 towards the axial end face 26 of the crankpin 21.

The circumferential wall 28 has upper edge 29 which may have a tapered or rounded shape.

Particularly, the circumferential wall 28 extends notably in a region 30 where bearing loads F applied on the outer circumferential surface 23 of the crankpin 21 are maximal. Advantageously, the circumferential wall 28 has a thickness and a height which are configured to ensure pure elastic deformation of the circumferential wall 28 during operation of the scroll compressor 2, and the recess 25 has a depth which is configured such that the circumferential wall 28 axially overlaps at least a portion of the orbiting scroll bearing 24.

Due to such a configuration of the circumferential wall 28, the latter is deformable in a radial direction when the orbiting scroll 9 performs tilting or wobbling movements, particularly in the region 30 where bearing loads F applied on the outer circumferential surface 23 of the crankpin 21 are maximal.

Consequently, the contact pressure between the orbiting scroll bearing 24 and the outer circumferential surface 23 of the crankpin 21 strongly reduces during operation of the scroll compressor 2, which increases the lifetime of the orbiting scroll bearing 24.

The vertical drive shaft 19 further includes an oil supplying channel 31 configured to fluidly communicate with an oil sump 32 of the scroll compressor 2. Particularly, the oil supplying channel 31 extending over the entire length of the vertical drive shaft 19 and has an upper end emerging into the axial end face 26 of the crankpin 21.

FIGS. 5 and 6 represent the vertical drive shaft 19 of a scroll compressor 2 according to a second embodiment of the invention which differs from the scroll compressor 2 of FIGS. 1 to 4 essentially in that the recess 25 is formed by a semi-circular groove and in that the circumferential wall 28 has an arcuate shape and extends along only a part of the circumference of the crankpin 21.

Particularly, the circumferential wall 28 extends in the region 30 where bearing loads F applied on the outer circumferential surface 23 of the crankpin 21 are maximal and between a first predetermined circumferential position P1 and a second predetermined circumferential position P2 over an angle of around 180° centred on the crankpin axis.

According to the second embodiment of the invention, the first predetermined circumferential position P1 is located in a first half-space defined by a reference plane P including the crankpin axis B and a rotational axis A of the vertical drive shaft 19, and the second predetermined circumferential position P2 is located in a second half-space defined by the reference plane P.

A first orthogonal projection of the first predetermined circumferential position P1 in a projection plane, which is orthogonal to the crankpin axis B and to the rotational axis A of the vertical drive shaft 19, and a reference half-line, which includes an initial point corresponding to an orthogonal projection of the crankpin axis B in the projection plane and which passes through a reference point corresponding to an orthogonal projection of the rotational axis A of the vertical drive shaft 19 in the projection plane, define a first angle $\alpha$ which is centred on the initial point and which is around 45°, the first angle $\alpha$ being measured in a first measurement direction from the reference half-line.

Advantageously, the reference half-line and a second orthogonal projection of the second predetermined circumferential position P2 in the projection plane define a second angle β which is centred on the initial point and which is around 135°, the second angle β being measured in a second measurement direction from the reference half-line which is opposite to the first measurement direction. According to another embodiment of the invention, the first angle α may be around 0°, and the second angle β may be around 120°.

FIGS. 7 and 8 represent the vertical drive shaft 19 of a scroll compressor 2 according to a third embodiment of the invention which differs from the scroll compressor 2 of FIGS. 5 and 6 essentially in that the recess 25 has half-disc shape.

Of course, the invention is not restricted to the embodiments described above by way of non-limiting examples, but on the contrary it encompasses all embodiments thereof.

What is claimed is:

1. A scroll compressor comprising:

a fixed scroll having a fixed end plate and a fixed spiral wrap extending from the fixed end plate, an orbiting scroll having an orbiting end plate and an orbiting spiral wrap extending from the orbiting end plate, the fixed spiral wrap and the orbiting spiral wrap meshing with each other to form compression chambers, a vertical drive shaft having a crankpin at an upper end portion of the vertical drive shaft, the crankpin including an outer circumferential surface cooperating with an orbiting scroll bearing, wherein the crankpin includes a recess formed in an axial end face of the crankpin, the recess and an upper portion of the outer circumferential surface defining therebetween a circumferential wall extending along at least a part of the circumference of the crankpin, the circumferential wall defining a crankpin portion having a reduced stiffness and being deformable in a radial direction during operation of the scroll compressor, and wherein the circumferential wall extends over an angle of at least 90° and no more than 180° centered on a crankpin axis of the crankpin.

2. The scroll compressor according to claim 1, wherein the circumferential wall has a curved shape.

3. The scroll compressor according to claim 2, wherein the recess is radially shifted from the outer circumferential surface of the crankpin.

4. The scroll compressor according to claim 2, wherein the circumferential wall extends at least in a region where bearing loads applied on the outer circumferential surface of the crankpin are maximal.

5. The scroll compressor according to claim 1, wherein the circumferential wall has a substantially constant thickness along a circumference thereof.

6. The scroll compressor according to claim 5, wherein the recess is radially shifted from the outer circumferential surface of the crankpin.

7. The scroll compressor according to claim 1, wherein the recess is radially shifted from the outer circumferential surface of the crankpin.

8. The scroll compressor according to claim 1, wherein the circumferential wall extends at least in a region where bearing loads applied on the outer circumferential surface of the crankpin are maximal.

9. The scroll compressor according to claim 1, wherein the circumferential wall extends between a first predetermined circumferential position and a second predetermined circumferential position over an angle of at least 120° and no more than 180° centered on a crankpin axis of the crankpin.

10. The scroll compressor according to claim 9, wherein the first predetermined circumferential position is located in a first half-space defined by a reference plane including the crankpin axis and a rotational axis of the vertical drive shaft, and the second predetermined circumferential position is located in a second half-space defined by the reference plane.

11. The scroll compressor according to claim 9, wherein a first orthogonal projection of the first predetermined circumferential position in a projection plane, which is orthogonal to the crankpin axis and to the rotational axis of the vertical drive shaft, and a reference half-line, which includes an initial point corresponding to an orthogonal projection of the crankpin axis in the projection plane and which passes through a reference point corresponding to an orthogonal projection of the rotational axis of the vertical drive shaft in the projection plane, define a first angle (a) which is centered on the initial point and which is between 0° and 180°, the first angle (a) being measured in a first measurement direction from the reference half-line.

12. The scroll compressor according to claim 11, wherein the reference half-line and a second orthogonal projection of the second predetermined circumferential position in the projection plane define a second angle (β) which is centered on the initial point and which is between 90° and 180°, the second angle (β) being measured in a second measurement direction from the reference half-line which is opposite to the first measurement direction.

13. The scroll compressor according to claim 1, wherein the circumferential wall has a thickness and a height which are configured to ensure pure elastic deformation of the circumferential wall during operation of the scroll compressor.

14. The scroll compressor according to claim 1, wherein the recess has a depth which is configured such that the circumferential wall axially overlaps at least a portion of the orbiting scroll bearing.

15. The scroll compressor according to claim 1, wherein the recess is formed by a groove.

16. The scroll compressor according to claim 1, wherein the recess has a substantially half-disc shape.

17. The scroll compressor according to claim 1, wherein the circumferential wall has an upper edge having a tapered or rounded shape.

18. A vertical drive shaft for a scroll compressor, having a crankpin at an upper end portion of the vertical drive shaft, the crankpin including an outer circumferential surface configured to cooperate with an orbiting scroll bearing, wherein the crankpin includes a recess formed in an axial end face of the crankpin, the recess and an upper portion of the outer circumferential surface defining therebetween a circumferential wall extending along at least a part of the circumference of the crankpin, the circumferential wall defining a crankpin portion having a reduced stiffness and being deformable in a radial direction during operation of the scroll compressor, wherein the circumferential wall extends over an angle of at least 90° and no more than 180° centered on a crankpin axis of the crankpin.

19. A scroll compressor comprising:

a fixed scroll having a fixed end plate and a fixed spiral wrap extending from the fixed end plate, an orbiting scroll having an orbiting end plate and an orbiting spiral wrap extending from the orbiting end plate, the fixed spiral wrap and the orbiting spiral wrap meshing with each other to form compression chambers, a vertical drive shaft having a crankpin at an upper end portion of the vertical drive shaft, the crankpin including an outer circumferential surface cooperating with an orbiting scroll bearing, wherein the crankpin includes a recess formed in an axial end face of the crankpin, the recess and an upper portion of the outer circumferential surface defining therebetween a circumferential wall extending along at least a part of the circumference of the crankpin, the circumferential wall being deformable in a radial direction during operation of the scroll compressor, and wherein the circumferential wall extends between a first predetermined circumferential position and a second predetermined circumferential position over an angle of at least 90° and no more than 180° centered on a crankpin axis of the crankpin.

* * * * *